US007228892B2

(12) United States Patent
Lagerström et al.

(10) Patent No.: US 7,228,892 B2
(45) Date of Patent: Jun. 12, 2007

(54) HEAT EXCHANGER DEVICE AND A METHOD FOR MANUFACTURING THE SAME

(75) Inventors: Gunnar Lagerström, Sollebrunn (SE); Max Xie, Lund (SE)

(73) Assignee: Rekuperator Svenska AB, Gothenburg (SE)

( * ) Notice: Subject to any disclaimer, the term of this patent is extended or adjusted under 35 U.S.C. 154(b) by 0 days.

(21) Appl. No.: 10/605,382

(22) Filed: Sep. 26, 2003

(65) Prior Publication Data

US 2004/0182555 A1 Sep. 23, 2004

Related U.S. Application Data

(63) Continuation of application No. PCT/SE02/00559, filed on Mar. 22, 2002, now abandoned.

(30) Foreign Application Priority Data

Mar. 27, 2001 (SE) ..... 0101085

(51) Int. Cl.
*F28F 3/10* (2006.01)

(52) U.S. Cl. ..... 165/166; 165/DIG. 387

(58) Field of Classification Search ..... 165/146, 165/166, DIG. 367, 368
See application file for complete search history.

(56) References Cited

U.S. PATENT DOCUMENTS 1,409,967 A 3/1922 Prat
2,868,514 A * 1/1959 Hodson et al. ..... 165/170
2,995,344 A * 8/1961 Hryniszak ..... 165/166
3,291,206 A * 12/1966 Nicholson ..... 165/166
3,613,782 A * 10/1971 Mason et al. ..... 165/166
4,116,271 A * 9/1978 De Lepeleire ..... 165/166
4,475,589 A * 10/1984 Mizuno et al. ..... 165/166
4,524,728 A * 6/1985 Johnson ..... 122/459
4,569,391 A * 2/1986 Hulswitt et al. ..... 165/166
5,400,854 A * 3/1995 Iio et al. ..... 165/157
5,469,914 A * 11/1995 Davison et al. ..... 165/166
6,516,874 B2 * 2/2003 Mathur et al. ..... 165/166

FOREIGN PATENT DOCUMENTS

DE 4433659 C1 12/1995
GB 229242 A 3/1925
GB 1048122 A 11/1966

* cited by examiner

*Primary Examiner*—Allen J. Flanigan
(74) *Attorney, Agent, or Firm*—Novak Druce + Quigg, LLP

(57) ABSTRACT

Method and device for providing a plate heat exchanger (1) having a number of corrugated plates (2). Between the corrugated plates (2) first and second flow channels (7, 8) are arranged, which first flow channels (7), via first inlet openings (11) and first outlet openings (12), are connected essentially parallel to in-going and out-going junction channels (13, 14). The plates (2) are fitted to each other in pairs, forming cells (15) including an inner spacing element (16) welded to and between the plates, and outer spacing elements (17) welded to the plates (2) on the sides of the plates (2) facing away from each other, along at least two of the edge parts (3–6). The cells (15) are stacked against each other and joined together by welding of the outer spacing elements (17), and in that said in-going and out-going junction channels (13, 14) are welded to said first inlet openings (11) and first outlet openings (12) respectively.

11 Claims, 7 Drawing Sheets

HEAT EXCHANGER DEVICE AND A METHOD FOR MANUFACTURING THE SAME

CROSS REFERENCE TO RELATED APPLICATIONS

The present application is a continuation patent application of International Application No. PCT/SE02/00559 filed 22 Mar. 2002 which was published in English pursuant to Article 21(2) of the Patent Cooperation Treaty, and which claims priority to Swedish Application No. 0101085-9 filed 27 Mar. 2001. Both applications are expressly incorporated herein by reference in their entireties.

BACKGROUND OF INVENTION

1. Field of the Invention

The present invention refers to a heat exchanger device, also called recuperator, which advantageously is intended for use with a gas turbine for stationary use in a small-scale power station or for mobile use in a vehicle. The invention also refers to a method for manufacturing the heat exchanger.

2. Background Art

A heat exchanger of the above-mentioned type is used, for example, in small-scale power stations, for mobile use or in a reserve power station. In at least these applications, it is of great importance that the recuperator be designed in such a way that it be as effective as possible, while at the same time being light-weight, and with dimensions that are minimized or at least diminished. Recuperators conventionally have a number of plates made from a very thin plate material with a thickness of normally about 0.1 mm. The plates exhibit, in a known manner, corrugations and are stabilized toward each other in a wave shaped pattern. As a consequence, flow channels for a heat absorbing medium and flow channels for a heat-emitting medium are formed between the corrugations. In the case where a gas turbine is used, the heat-emitting medium is combustion gas from the gas turbine and the heat-absorbing medium is normally air. It is of great importance for the efficiency of the recuperator as to how the corrugations are stabilized against each other, what angle is formed between the corrugations, and the size of the flow channels. All of the mentioned factors affect the flow characteristics in the recuperator, and the flow characteristics are a big part of optimizing the heat exchange between the heat absorbing medium and the heat-emitting medium.

According to one known method for manufacturing a flat heat exchanger, the plates are soldered together into a cell, with the aid of vacuum soldering. This method operates satisfactorily when manufacturing stationary flat heat exchangers where the thickness of the plates is about 0.2–0.4 mm. In order to manufacture recuperators for mobile use or small-scale power stations, even thinner plates are necessary having thicknesses of about 0.1 mm. The recuperator intended for small-scale power stations has plates that consequently are very thin, and as a result problems occur when using previously known vacuum soldering techniques for the joining of the plates. The proportionately high quantity of heat that is supplied to the material when using vacuum soldering technique may lead to a localized, thermally conditioned structural collapse of a number of corrugations in the thin plates, whereby the flow channels are narrowed or blocked and where the function of the recuperator no longer can be ensured.

It is also previously known to form cells by welding the plates in pairs with spacing elements lying in-between the plates with the aid of TIG-welding apparatus, but problems will occur here also. One of the problems when welding thin plates with a TIG-welding apparatus is that the cell will buckle due to the fact that the heat distribution is too great.

Even if known systems are well functioning, improvements are possible with respect to obtaining a more compact recuperator. In conventional designs, the plates that form the cells, and thus the recuperator, are formed with specially adapted channel openings in the plates that are supposed to fit to channel openings in other plates and thereby form to and from flow channels. This has resulted in unnecessarily high demands on fit and tolerances and has also made it difficult to manufacture one plate in one process step. In order for the recuperator to function satisfactorily, high demands are put on fit and tightness between the plates and the inlet and outlet channel openings of the recuperator, as well as the formed rows of flow channels in the recuperator. The manufacture of such a recuperator may be expensive and the special demands make the device somewhat inflexible.

A further drawback with know devices of this nature is that the flow channels in the recuperator give a fairly skewed distribution and causes high pressure losses. These effects result in deterioration in the efficiency of the system and obstructs the distribution of the various media.

When using previously known techniques as described above, cells are formed either by welding or soldering of plates in pairs with interstitial or interjacent spacing elements. In this way flow channels are formed between the plates for the heat absorbing medium. When forming the recuperator, the cells are stacked against each other so that flow channels for the heat-emitting medium are formed between the cells. One demand on a well-functioning recuperator is that it be gas tight at least at certain places. The demand for gas tightness puts high demands on the contact surfaces between the cells on at least two opposing edge parts that must be made gas tight. Conventional recuperators have made the end parts gas tight by using bolting arrangements that press the end parts towards each other, and also gas tight cover plates placed over the joints in between the cells, or a gas tight box. The cover plates are thereafter welded to an L-flange and placed around the inlet opening for the heat-emitting medium. In this manner, the flange also serves as a connection flange for the heat-emitting medium. The cover plates are also welded to junction channels placed on the recuperator formed by the cells. In spite of bolting and cover plates, leakage of the heat-emitting medium to the surrounding environment is common when using this construction of the recuperator. When using bolting, a number of bolts are placed perpendicular to the plates and perpendicular to the flow direction of the heat-emitting medium. When using such recuperators, a number of problems occur. One of the problems is the difficulty with the fit in order to get the contact surface between the cells gas tight, which puts high demands on tolerances of the gas tight side parts that are to be fitted in between the cells formed joints, and also demands very clean and flat contact surfaces. A further problem is that the bolts in the bolting arrangement have to be put in the correct place for the construction, and have to be tightened in such a way that a high and even pressure is applied over the gas tight contact surfaces between all the cells. Still a further problem with using bolting is that the bolts are placed in the heat-emitting medium stream flow and interfere with the flow characteristics and the distribution of the medium over the channel inlets. The recuperators mentioned above are consequently difficult, and thus expensive, to manufacture and are also large and heavy in relation to their efficiency.

In order for a recuperator suitable for use in small-scale power stations to be commercially competitive, it is a demand that the recuperator have a small volume compared to the amount of energy used. It is also a demand that the recuperator be simple to manufacture and have a low manufacturing cost.

SUMMARY OF INVENTION

An object of the present invention is to obviate the problems outlined herein above relative to conventionally designed recuperators thereby providing an improved recuperator with a more simple and inexpensive manufacturing method.

The above stated object is met by a plate heat exchanger of the nature described above, and more particularly through the provision of a plate heat exchanger, preferably for use with a gas turbine, that includes a number of corrugated plates. Each of the plates has a first edge part and an opposing second edge part, a third edge part and an opposing fourth edge part, where first and second flow channels are arranged between the corrugated plates. Every first flow channels is arranged to have a through flow of a heat-emitting medium and every second flow channel is arranged to have a through flow of a heat absorbing medium. The first flow channels for one of the mediums are, via first inlet openings and first outlet openings, connected essentially parallel to in-going and out-going junction channels, respectively, for the heat absorbing medium. The invention is characterized in that the plates are fitted to each other in pairs, thereby forming cells comprising (including, but not limited to) an inner spacing element welded to and in between the plates. The spacing element extends along the edge parts with interruptions for the first inlet openings and the first outlet openings for one of the mediums, and advantageously, the heat-absorbing medium. Furthermore, outer spacing elements are welded to the plates, on the sides of the plates, facing away from each other, along at least two of the edge parts. The cells are stacked against each other and joined together by welding via the outer spacing elements, and said in-going and out-going junction channels are welded to the first inlet opening and first outlet opening respectively.

One of the advantages with welding the outer spacing elements to each other is that a gas tight side is formed. Furthermore, when the in-going and out-going junction channels, respectively, are welded to the gas tight formed side, the recuperator will become self-supported. The short ends on the in-going and out-going junction channels are advantageously covered with gas tight end cover plates, which also advantageously are welded to the edge parts of the closest plate. Both end cover plates are thus made from a plate that is placed and welded in such a way that it covers the whole short side of the recuperator. To and from connections for the different mediums are welded to the in-going and out-going junction channels advantageously at an angle to the longitudinal extension of the junction channels, close to the respective short ends. When connecting the connections, holes are made in the in-going and out-going junction channels respectively.

When the heat-absorbing medium is flowing in the cell, the medium expands in the cell, which affects the pressure losses and the flow rate. In order to compensate for this expansion, the first outlet opening is wider than the first inlet opening.

The inner spacing element of the cell consists of a first L-shaped inner spacing element along the first and fourth edge parts and a second L-shaped inner spacing element along the second and third edge parts. The shape of the first and second inner spacing elements determines, among other things, the shape of the first inlet and outlet openings. During the manufacturing process of the cells, the inner spacing elements are welded to two plates. After this, the cells are welded to each other via the outer spacing element which has been described above. In order to strengthen the plates at the first inlet and outlet openings, and in order to prevent the plates from buckling during the welding operation, according to the invention, spacing elements are placed in the respective openings by the first inner spacing element having a first end section thinner than the rest of the first spacing element, where the first end section is pleated along the extension of the first inlet opening, and the second inner spacing element having a second end section thinner than the rest of the second spacing element, where the second end section is pleated along the extension of the first outlet opening. Each of the pleated end sections of the first and second inner spacing elements has a first pleating height and a second pleating height respectively, which thus allows the pleated end sections to act as spacing elements in the first inlet and outlet openings respectively.

The corrugated plates are divided into first plates with a first and a second side, corrugated with a first pattern, and second plates with a third and fourth side corrugated with a second pattern. When forming the cells, the first and second plates are assembled in pairs with the second side towards the third side. The first and second plates are corrugated with different patterns in order to form suitable channels when forming the cell.

The first plates are corrugated in such a way that each of the first plates has first depressions and first ridges on the first side, and correspondingly second depressions and second ridges on the second side, diagonally from the third edge part to the fourth edge part, with the first edge part and the fourth edge part constituting leg-portions in an imaginary triangle with the diagonal first depressions as the hypotenuse. The second plates are corrugated in such a way that each of the second plates has third depressions and third ridges on the third side, and correspondingly fourth depressions and fourth ridges on the fourth side, diagonally from the third edge part to the fourth edge part, with the first edge part and the third edge part constituting legs in an imaginary triangle with the diagonal third depressions as hypotenuse.

The depth of the first and fourth depressions, respectively, varies in such a way that a first inlet triangle and a first outlet triangle with a first depth of the first depressions are formed in the first plate, and a second inlet triangle and a second outlet triangle with a second depth of the fourth depressions are formed in the second plate. Each of the first and second inlet triangles has a feature in the shape of a triangle at each of the plates, with an imaginary cathetus (perpendicular component) along the first edge part with a length corresponding to the first inlet opening, an imaginary cathetus in the third end part and a hypotenuse from the first edge part to the second edge part. Each of the first and second outlet triangles has the shape of an imaginary cathetus (lines laying at right angles) along the second edge part with a length corresponding to the first outlet opening, an imaginary cathetus in the fourth edge part and an imaginary hypotenuse from the second edge part to the to the first edge part. The first plate also has a first diagonal section with a third depth of the first depressions. The second plate has a second diagonal section with a fourth depth of the fourth depressions. The diagonal sections are formed diagonally over each of the plates between the inlet triangles and outlet triangles, respectively.

At each of the first and second plates, the first inlet triangle and the second inlet triangle have the same geometrical shape and the first diagonal section, and the second diagonal section have the same geometrical shape, and the first outlet triangle and the second outlet triangle have the same geometrical shape.

The cells consist of the first and second plates joined in pairs with the second and third sides placed towards each other, wherein the second ridges form an angle with the third ridges, and where the first and second inlet triangles form a first cross-stream section, and where the first and second outlet triangles form a second cross-stream section, and where the first and second diagonal sections form a counter-stream section. The second ridges are in contact with the third ridges in the first points of intersection at that part of the cell that is formed by the diagonal section of the plates.

The design of the plates with a lower depth of the corrugations in the cross-stream sections allows the medium that flows in the cell to flow freely in the respective triangular cross-stream section, which consequently means a suitable distribution of the medium over the cross-stream section, resulting in yields a distribution of pressure losses and an enhanced heat absorption ability.

The cells are stacked against each other with the first and fourth sides of the plates towards each other. Since the corrugations are formed in such a way that the first ridges and the fourth ridges, respectively, have the same height over the entire plate on the first and fourth sides, respectively, the first ridges form an angle to the fourth ridges when the cells are stacked, and additionally the first ridges are in contact with the fourth ridges in second points of intersection.

The thickness of the outer spacing element is such that the upper edge of the outer spacing elements is in alignment with the first ridges on the first side and is in alignment with the fourth ridges on the fourth side.

The thickness of the outer spacing element is essentially twice the thickness of the inner spacing element.

In order to further strengthen the construction and to symmetrically distribute the medium that flows in the cells, additional in-going and out-going junction channels may be welded to the recuperator parallel to the in-going and out-going junction channels, on the opposite side of the recuperator sides formed by the cells to which the previously mentioned in-going and out-going junction channels are welded. The short ends of the in-going and out-going junction channels respectively are advantageously covered with gas tight end cover plates in accordance with the above, which strengthens the self-supporting structure.

When using an arrangement including four junction channels, it is necessary that additional inlet and outlet openings are arranged in the cell on that distance that is formed by the width of each of the longitudinal openings of the in-going and out-going junction channels. The additional inlet and outlet openings are advantageously formed by arranging the inner spacing elements in the same way as for the first inlet and outlet openings.

In order to be able to manufacture a recuperator in the above-mentioned way, it is necessary to use a welding technique that has a selective and localized propagation of heat, which diminishes the risk of buckling the plates when performing the welding. One welding technique suitable for the manufacturing of a recuperator in accordance with the invention is laser welding.

BRIEF DESCRIPTION OF DRAWINGS

The invention is described hereinbelow regarding an exemplary and preferred embodiment, aspects of which are illustrated in the accompanying drawings and in which.

DETAILED DESCRIPTION

Figure 5A:
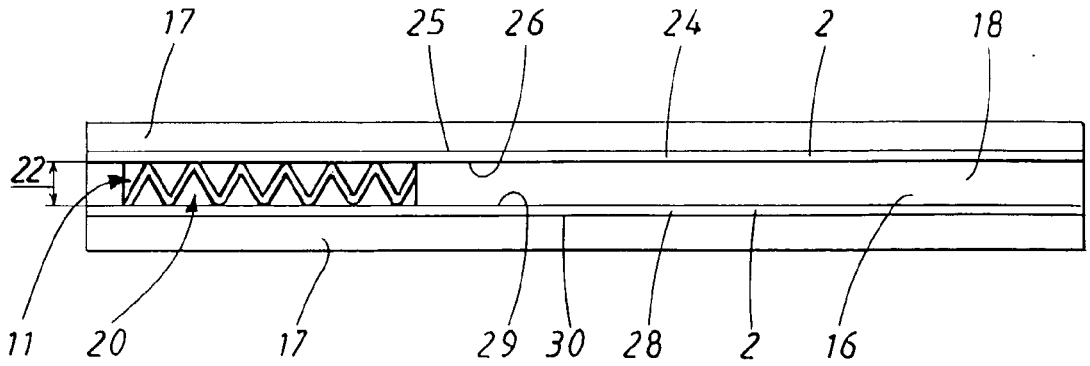
FIG. 5*a* is a schematic view showing an inlet opening of a cell configured according to the invention.
Figure 5B:
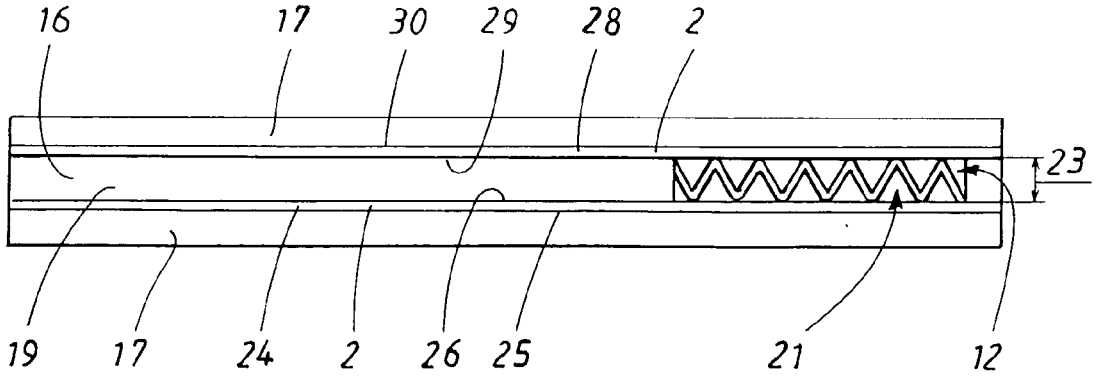
FIG. 5*b* is a schematic view showing an outlet opening of a cell configured according to the invention.
Figure 6:
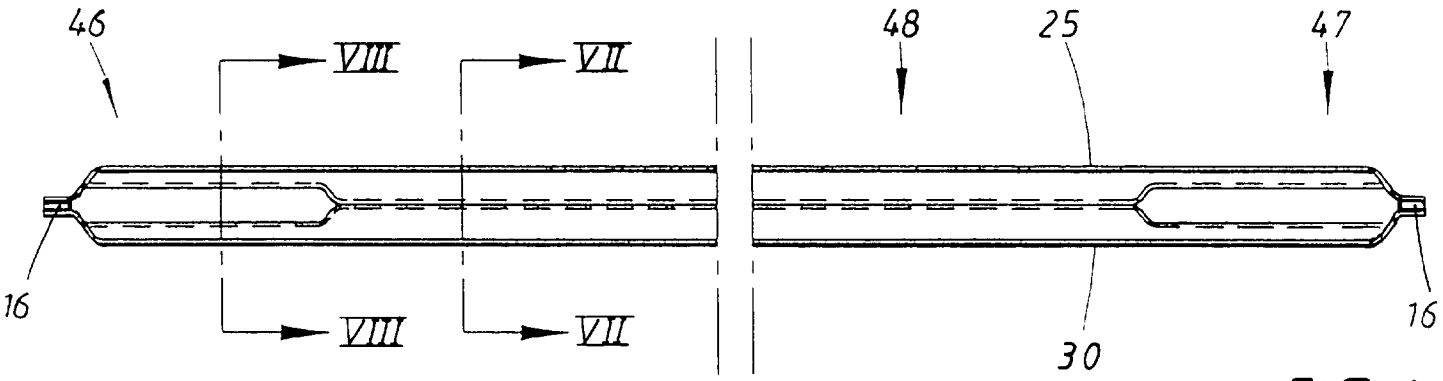
FIG. 6 is a schematic view showing a cross-section along the line VI—VI in FIG. 4.
Figure 7:
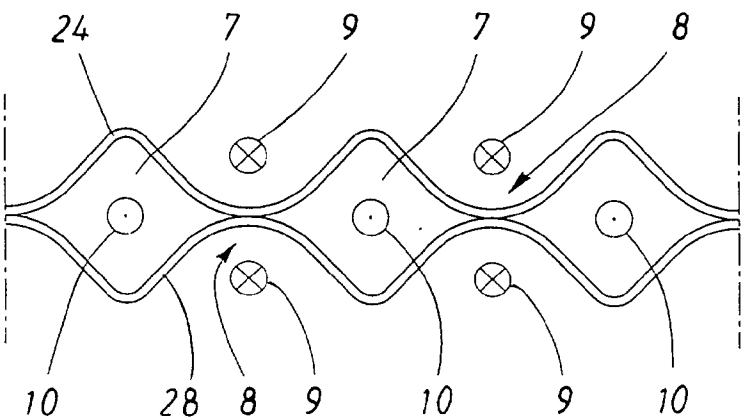
FIG. 7 is a schematic view showing a cross-section along the line VII—VII in FIG. 6.
Figure 9:
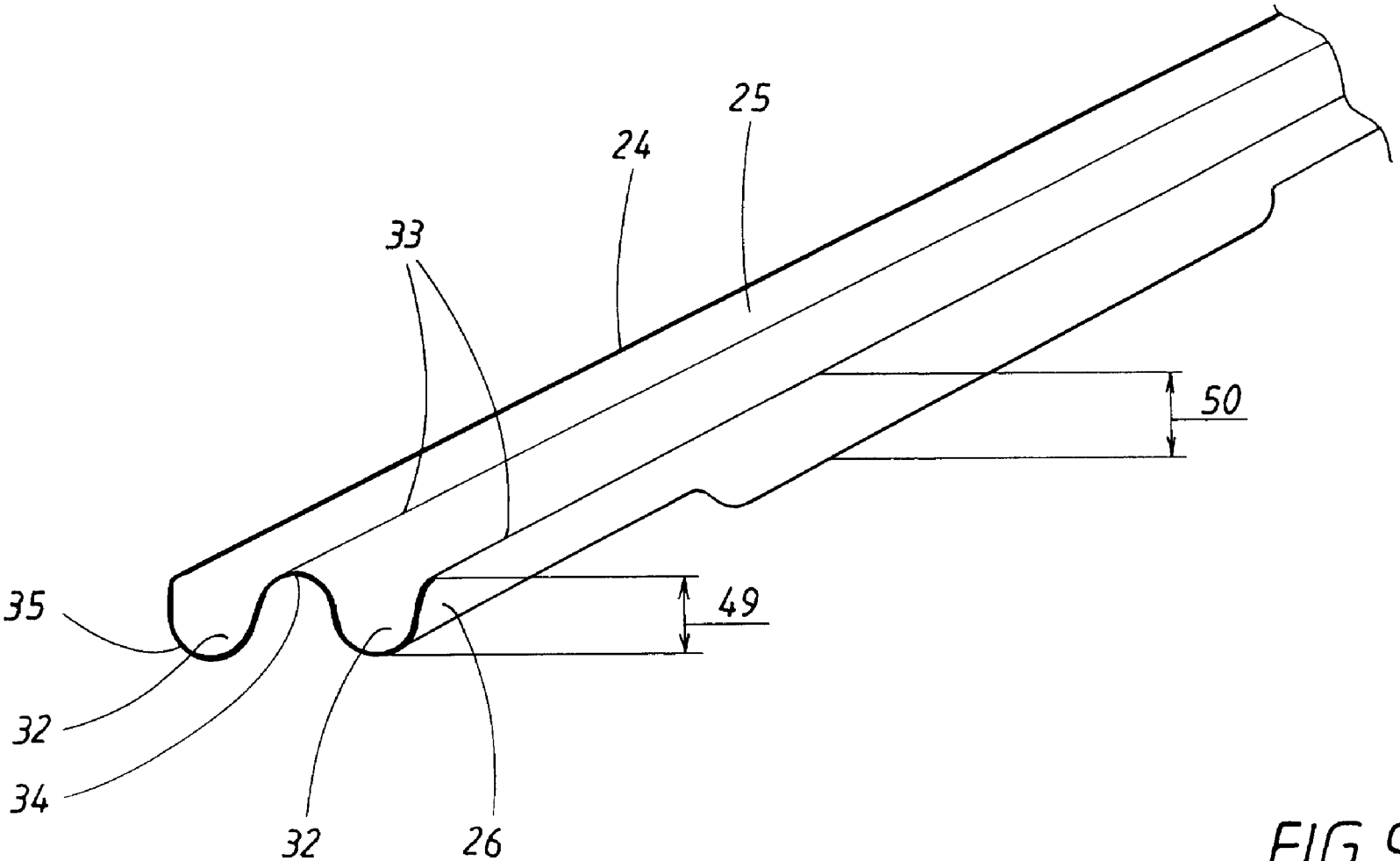
FIG. 9 is a schematic view showing a perspective view in cross-section of a part of the upper plate depicted in FIG. 6.

In FIGS. 1–9, descriptive exemplary representations of the invention are shown as a plate heat exchanger 1 of a type that is preferably intended for use with a gas turbine and in which the plate heat exchanger includes a number of corrugated plates 2. The features that recur in the different Figs. are denoted with the same reference numbers. Each of the plates 2 has a first edge part 3 and an opposing second edge part 4, a third edge part 5 and an opposing fourth edge part 6. Between the corrugated plates 2, first and second flow channels 7, 8 are arranged, where every first flow channel is arranged to have a through flow of a heat-emitting medium 9. This is depicted in FIG. 7 and is designated by the symbol of an out-going arrow exemplifying combustion gases from a gas turbine, and every second is arranged to have a through flow of a heat absorbing medium 10 that is depicted in FIG. 7 and is designated by the symbol of an incoming arrow representing incoming air. The first flow channels 7 for one of the mediums, advantageously the heat absorbing medium 10, are essentially via first inlet openings and first outlet openings 11, 12, connected essentially parallel to each of the in-going and out-going junction channels 13, 14 for the heat absorbing medium 10. The first inlet openings 11 and the first outlet openings 12 are formed when the plates are assembled, which is described more thoroughly hereinbelow.

The plates 2 are assembled in pairs and thus form cells 15. Between the plates 2 an inner spacing element is inserted and joined to the plates via welding along the edge parts 3–6, with interruptions for said first inlet openings 11 and the first outlet openings 12 for one of the mediums, advantageously the heat absorbing medium 10. Furthermore, at least two outer spacing elements 17 are welded to the plates on the sides of the plates 2 facing away from each other, along at least two of the edge parts 3–6. In the figures the two outer spacing elements are attached to each of the first and second edge parts 3, 6. The welding of the inner spacing element 16 to the plates is advantageously done simultaneously with the welding of the outer spacing elements 17, but may also be welded before or after the welding of the outer spacing elements.

The cells 15 are stacked against each other and are joined together by welding. Advantageously, the outer spacing elements 17 are welded together, after which the entire part of the recuperator that is made from the stacked cells 15 is welded over the entire side where the outer spacing elements 17 are arranged.

When the cells 15 have been stacked against each other, the first inlet openings 11 will be lying essentially parallel to each other, and the first outlet openings 12 will be lying essentially parallel to each other. The parallel-lying inlet and outlet openings 11, 12 are then welded to the in-going and out-going junction channels 13, 14, which advantageously are made from essentially cylindrical elements with a longitudinal opening with a width that corresponds to the first inlet openings 11 and the first outlet openings 12, respectively, but may also be made with another geometrical structure suitable for the purpose; for example, square, oval, tapered cylindrical, and other suitable shapes.

Since the recuperator is welded together via the outer spacing elements, and, after that, via the in-going and out-going junction channels, a self-supporting structure is achieved with gas tight sides. An advantage compared to the prior art is that there no longer need be as close a fit as before, and that no bolting or the like is necessary in order to obtain a self supporting and gas tight structure.

Figure 1:
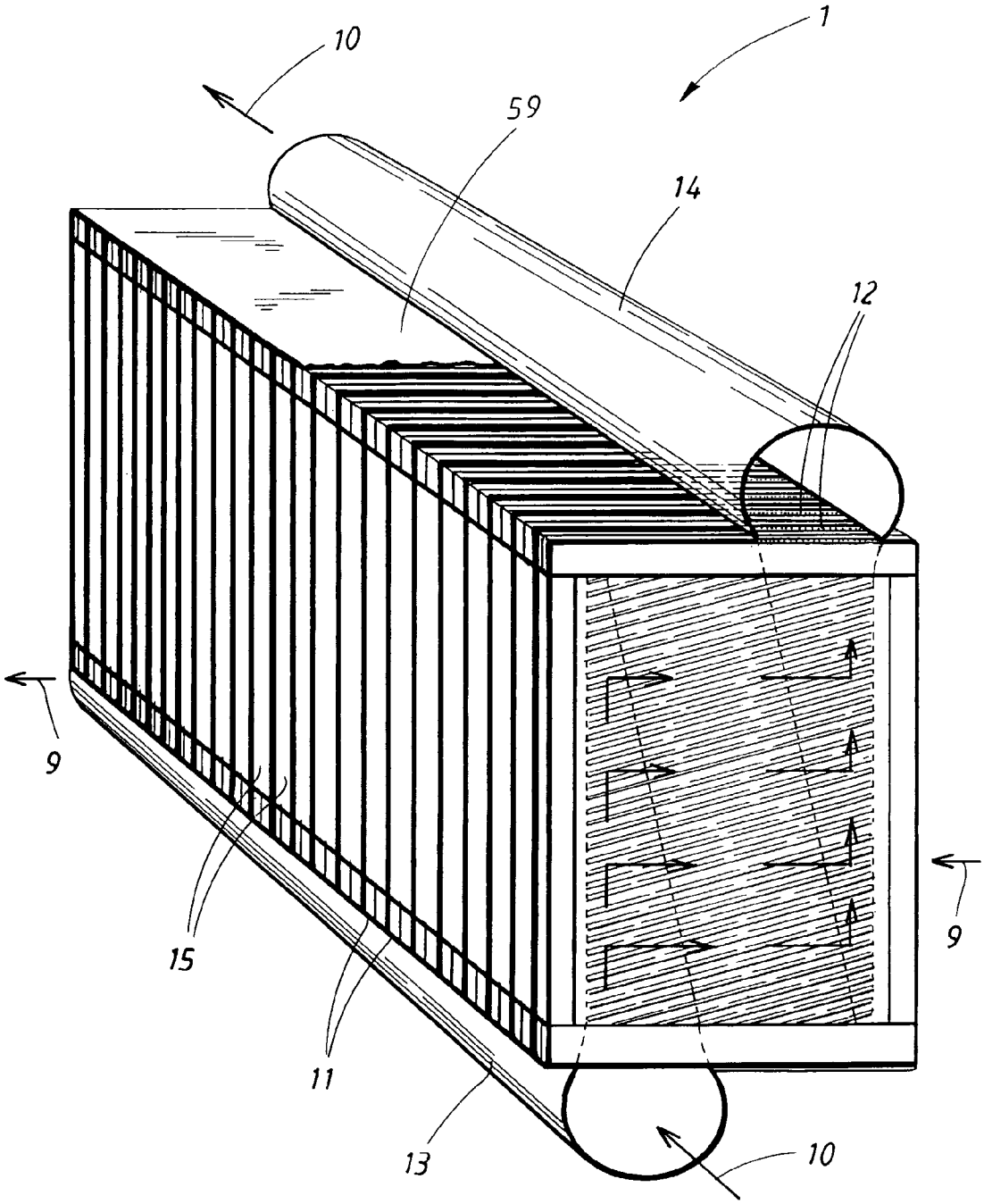
FIG. 1 is a schematic view showing a recuperator configured according to a first embodiment of the invention.
Figure 2:
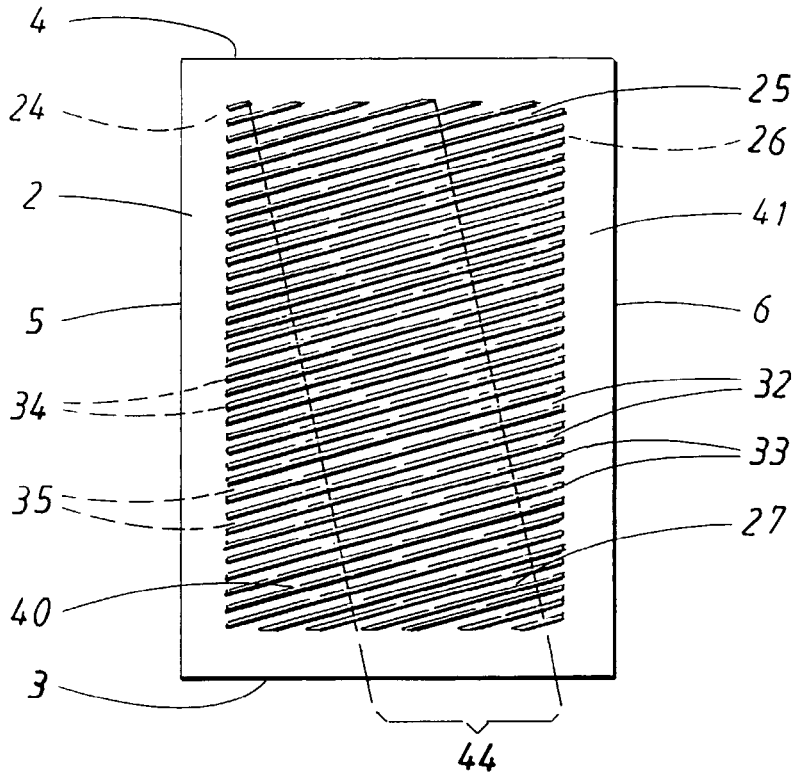
FIG. 2 is a schematic view showing two plates in the recuperator configured according to the invention.
Figure 2:
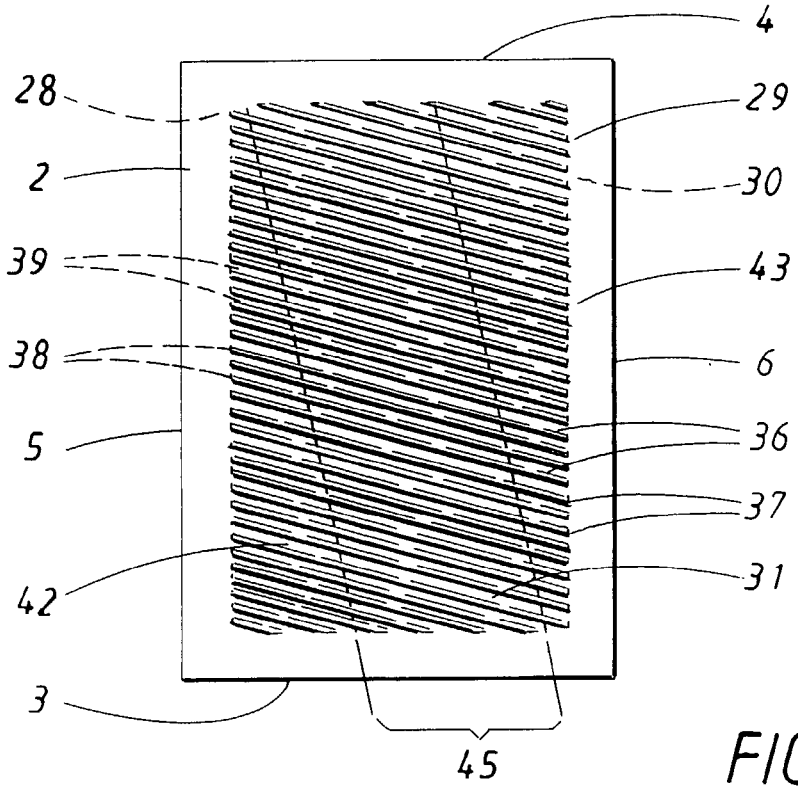
Figure 3:
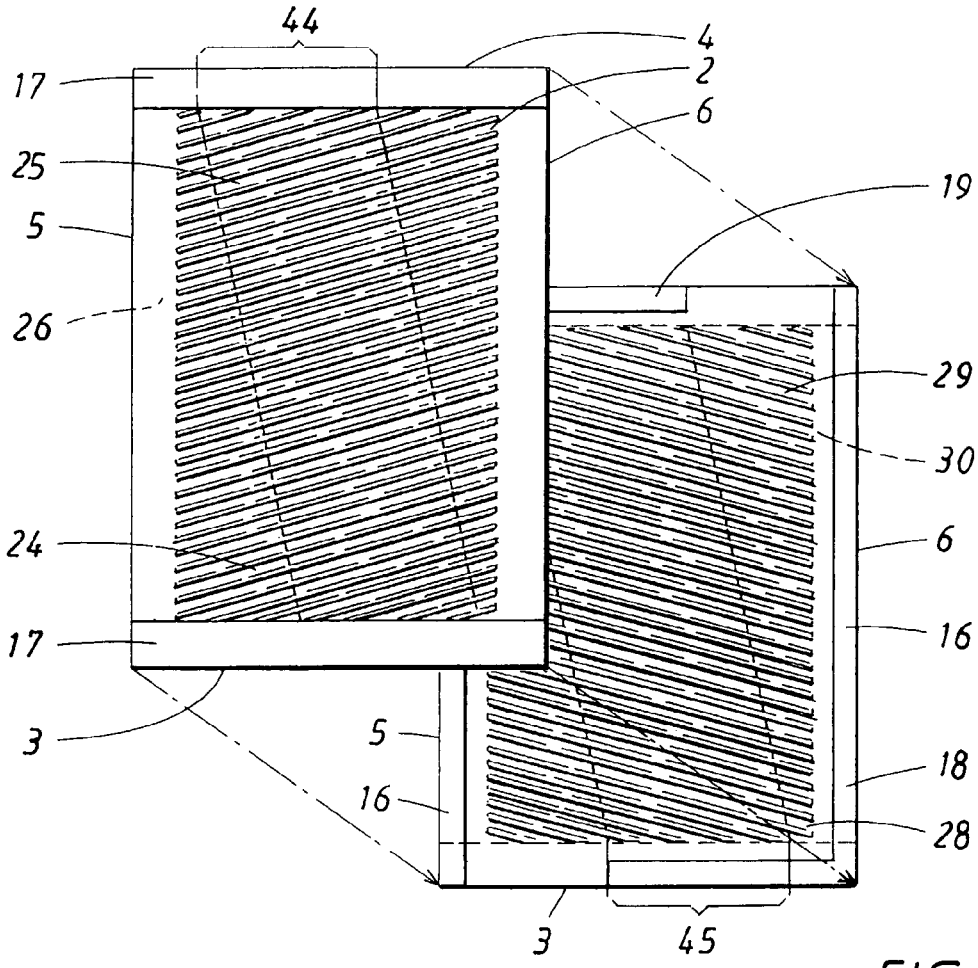
FIG. 3 is a schematic view showing the plates in FIG. 2 in superposition.
Figure 4:
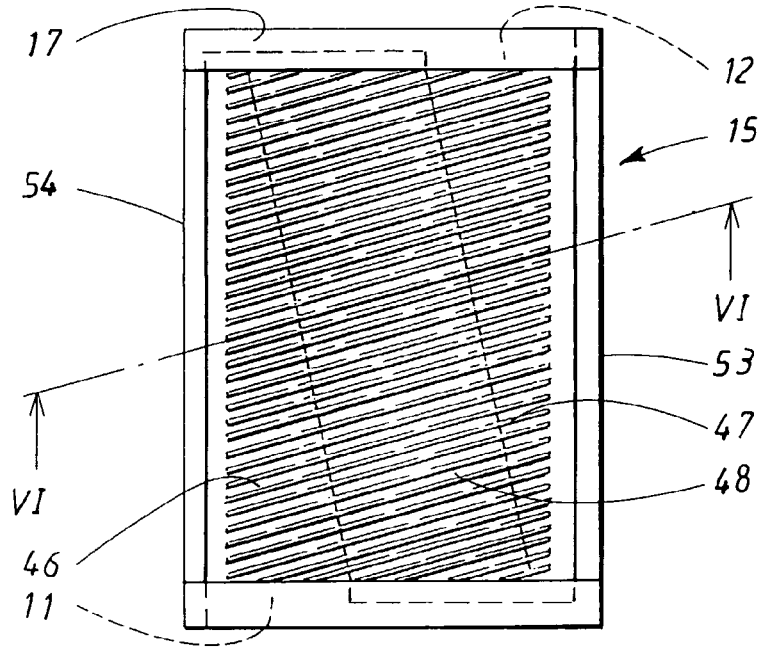
FIG. 4 is a schematic view showing the plates in FIG. 2 and 3 when they have been assembled to a cell according to the invention.

In FIG. 1, the construction of the recuperator is shown, and in order to simplify the description of the construction of the recuperator, some of the parts of the recuperator are not shown, but a covering plate 59 is depicted. When manufacturing the recuperator, gas tight end cover plates are welded to the short ends of the in-going and out-going junction channels 13, 14. The end cover plates are not shown in FIG. 1. The gas tight end cover plates are also advantageously welded to the edge parts 3–6 of the outermost plate 2 in the outermost cell 15. The gas tight end plates are welded to the in-going and out-going junction channels 13, 14, and together with the welded cells, form a self supporting structure in which gas tight cover plates 59 associated with conventional designs, as well as traditional bolting arrangements are not be necessary. However, gas tight cover plates and bolting may be used in order to further tighten and strengthen the structure. The present invention will, however, in such cases reduce the number of bolts and diminish the tolerance demands for welding the cover plates.

The gas tight end cover plates welded to the in-going and out-going junction channels 13, 14, advantageously cover the short ends of the in-going and out-going junction channels. In order to supply the respective medium to the recuperator, holes are made at suitable places along each of the in-going and out-going junction channels 13, 14, and after that in-going and out-going connections are welded to the provided holes that have been made but not shown in the figures. Advantageously, the connections are welded to the in-going and out-going junction channels in the vicinity of the respective short sides.

During large tensile load in the recuperator, it may be suitable to reinforce the construction by using bolting between the end cover plates. For example, bolts may be fitted symmetrically in relation to the in-going and out-going junction channels 13, 14; that is, the bolts may be fitted diagonally over the end cover plates on opposite sides of the in-going and out-going junction channels 13, 14.

The inner spacing element 16 of the cell 15 consists of a first L-shaped inner spacing element 18, placed on the plates 2 along the first edge part 3 and the fourth edge part 6 and a second L-shaped inner spacing element 19, placed on the plates along the second edge part 4 and the third edge part 5. The L-shaped first and second inner spacing elements 18, 19 are shaped in such a way that they completely cover two opposing sides; for example, the sides that are delimited by the third and fourth edge parts 5, 6, and also covering parts of the two remaining opposing sides, which, in the example, are delimited by the first and second edge parts 3, 4. When forming the cell, the parts of the side that is not covered by the inner spacing elements will form first inlet and outlet openings 11, 12. The first and second inner spacing elements 18,19 may also be made from a number of parts that form L-shaped elements when assembled, with the same function as the above described first and second inner spacing elements; that is, forming gas tight walls when forming the cell, along the mentioned edge parts.

In FIGS. 5*a* and 5*b*, one embodiment of the invention is shown in which the first inner spacing element 8 has a first end section 20 thinner than the rest of the first inner spacing element 8. The first end section 20 is pleated along the extension of the first inlet opening 11 and the second inner spacing element 19 has a second end section 21 thinner than the rest of the second inner spacing element 19. The second end section 21 is pleated along the extension of the first outlet opening 12. In this embodiment, the L-shaped first and second inner spacing elements 18, 19 are placed along the entire sides of the plates, with the first end section 20 placed in the first inlet opening 11 and the second end section 21 placed in the first outlet opening 12. The pleated end sections 20, 21 have a first and a second pleating height 22, 23, respectively, which allows the pleated end sections 20, 21 to act as spacing elements in the first inlet opening 11 and the first outlet opening 12, respectively. Consequently, the pleating height 22, 23 is such that when the plates 2 are welded together over the inner spacing elements 18, 19, the pleated end sections 20, 21 act as spacing elements in respective inlet and outlet openings 11, 12, in such a way that the outermost parts of the pleated end sections are in contact with the respective plates 2 and thus gives that the first inlet and outlet openings 11, 12 retaining their shape during the welding. The pleating heights 22, 23 correspond to the height of the respective inlet and outlet openings.

When welding the plates, it is important to use a welding method that guarantees a uniform and gas tight welding seam between the plates 2 and the first and second inner spacing elements 18, 19, and also gives a gas tight welding seam when the cells 15 are welded together via the outer spacing elements 17. It is also important that the propagation of heat of the various parts during the welding is as selective and localized as possible, in order to thereby diminish the risk that the plates 2, and thus the cells, buckle due to the heat load during the welding. A suitable welding technique that meets the above stated demands is laser welding, but any other similar and suitable welding method is acceptable.

When manufacturing a heat exchanger, it is important to get as much heat transfer surface per heat exchanger volume as possible, for example by means of pleated surface structures. Another important factor is that the mediums that are heat exchanging are flowing in a proper manner in order to emit heat or absorb heat in an optimal way. It is previously known that the best transport of heat between two mediums occurs during cross-stream flow. In order to establish cross-stream flow, the shape of the plates are of the utmost importance. Furthermore, the shape also determines, among other things, the pressure losses for the different mediums in the heat exchanger.

In one embodiment of the invention, the corrugated plates 2 are divided into first plates 24 with a first side 25 and a second side 26, corrugated with a first pattern 27, and second plates 28 with a third side 29 and fourth side 30, corrugated with a second pattern 31. When forming the cells, the first and second plates 24, 28 are assembled in pairs with the second side 26 towards the third side 29. The first plates 24 are corrugated in such a way that each of the first plates has first depressions 32 with first ridges 33 on the first side 25, and correspondingly second depressions 34 and second ridges 35 on the second side 26, diagonally from the third edge part 5 to the fourth edge part 6, with the first and the fourth edge parts 3, 6 constituting catheti (right-angle legs) in an imaginary triangle with the diagonal first depressions 32 as hypotenuse. The second plates 28 are corrugated in such a way that each of the second plates 28 has third depressions 36 and third ridges 37 on the third side 29, and correspondingly fourth depressions 38 and fourth ridges 39 on the fourth side 30, diagonally from the fourth edge part 6 to the third edge part 5, with the first and the third edge parts 3, 5 constituting catheti in an imaginary triangle with the diagonal third depressions 36 as hypotenuse. Ridges refer to the top of the longitudinal elevations formed during the corrugation and depressions refer to the bottom of the longitudinal depressions formed during the corrugation. The ridges on one side correspond to depressions on the other side. The ridges and the depressions at the different plates are intended to form flow channels when two or more plates are assembled, where the features of the flow channels are crucial for the flow characteristics of the mediums.

The corrugated pattern is, among other things, intended to increase the total amount of heat exchanging surface.

In one embodiment of the invention, the plates are corrugated with a certain pattern in order to create different types of flow channels when assembling the plates, and in order to get a suitable pressure loss distribution. The depth of the first and fourth depressions 32, 38 respectively varies in such a way that a first inlet triangle 40 and a first outlet triangle 41 with a first depth 49 on the first depressions 32 is formed in the first plate 24, and a second inlet triangle 42 and a second outlet triangle 43 with a second depth of the fourth depressions 38 is formed in the second plate 28. Each of the first and second inlet triangles 40, 42 has a feature in the shape of a triangle at each of the plates 24, 28, with an imaginary cathetus along the first edge part 3 with a length corresponding to the first inlet opening 11, an imaginary cathetus in the third end part 5 and a hypotenuse from the first edge part 3 to the second edge part 4. Each of the first and second outlet triangles 41, 43 has the shape of an imaginary cathetus along the second edge part 4 with a length corresponding to the first outlet opening 12, an imaginary cathetus in the fourth edge part 6 and an imaginary hypotenuse from the second edge part 4 to the to the first edge part 3. The depth of the first and fourth depressions 32, 38 varies in such a way that a first diagonal section 44 with a third depth 50 of the first depressions 32 is formed in the first plate, and a second diagonal section 45 with a fourth depth of the fourth depressions 38 is formed in the second plate 28. The diagonal sections 44, 45 are formed diagonally over each of the plates 24, 28 between the inlet triangles and outlet triangles, respectively.

In one embodiment of the invention, the first inlet triangle 40 has the same geometrical shape as the second inlet triangle 42, and the first diagonal section 44 has the same geometrical shape as the second diagonal section 45, and the first and second outlet triangles 41, 43 have the same geometrical shape. The inlet triangles, outlet triangles and the diagonal sections are geometrical structures described in order to describe the patterns formed on the surface of the plates due to differences in the depression depth. The patterns 27, 31 are shown, for example, in FIG. 2.

The cells 15, that consist of the first and second plates 24, 28 joined in pairs with the second and third sides 26, 29 placed towards each other, form first flow channels 7 in the cell by means of the second ridges 35 forming an angle with the third ridges 37. At that part of the cell 15 that is formed by the diagonal section 44, 45 of the plates, the second ridges 35 are in contact with the third ridges 37 in first points of intersection and the first flow channels 7 are formed mainly in this section. The thickness of the inner spacing elements 16 decides the bearing pressure in the first points of intersection. The first and second inlet triangles 40, 42 form a first cross-stream section 46, and the first and second outlet triangles 41, 43 form a second cross-stream section 47, and the first and second diagonal sections 44, 45 form a counter-stream section 48. Cross-stream section refers to the fact that the medium that flows within the cell (here the heat absorbing medium) in these sections flows mainly in a cross-stream direction compared to the medium that flows between the cells (here the heat-emitting medium). Counter-stream section refers to the fact that the medium that flows in these sections flows mainly in a counter-stream direction compared to the medium that flows between the cells. The second ridges 35 form an angle between the third ridges 37 and thus create suitable flow characteristics for the medium that flows in the counter-stream section (here the heat-absorbing medium 10) which increases the heat absorbing ability of the medium. The fact that there is contact in the first points of intersection, enhances the characterization of the flow characteristics, and furthermore, strengthens the entire recuperator structure when a number of cells are assembled. The angles possible between the second ridges 35 and third ridges 37 at the recuperator according to the invention are 5–45 degrees, and advantageously 14 degrees.

The first and second cross-stream sections 46, 47 are intended to distribute the medium that flows in and out of the cell; here, the heat-absorbing medium. When the medium flows in through the first inlet opening, the streaming medium shall, with regard to pressure losses, be distributed evenly over the first flow channels 7 in the counter flow section 48, where the distribution is achieved by the triangular shape of the first triangular cross-stream section 46. Also, the second cross-stream section 47 is triangular shaped in order to distribute pressure losses when the medium shall exit the cell via the first outlet opening 12. The first and second cross-stream sections 46, 47 are advantageously shaped in such a way that the first flow channels 7 in the counter-current section obtain essentially the same length.

Figure 8:
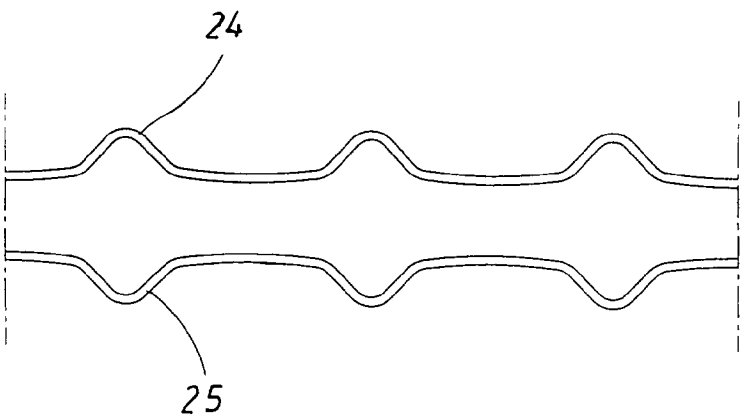
FIG. 8 is a schematic view showing a cross-section along the line VIII—VIII in FIG. 6.

In the cross-stream sections 46, 47, the respective second and third ridges 35, 37 have lower height than in the counter-current section, which is especially shown in FIGS. 6, 7 and 8. This has the advantage of not giving rise to any contact surfaces between the second and the third ridges 35, 37, which leads to an advantageous distribution of the pressure losses over the cell and thus over the channels that have been formed in the cross-stream section 48.

In order to form a recuperator, the different cells 15 are stacked against each other with the first and fourth sides 25, 30 of the plates 24, 24 towards each other. The first ridges 33 form an angle with the fourth ridges 39, forming the second flow channels 8. The first ridges 33 and the fourth ridges 39 advantageously have the same height over the entire respective plates 24, 28. The outer spacing elements 17 have preferably a thickness that allows the first ridges 33 and fourth ridges 39 to have contact in second points of intersection over the entire surface of the plates 24, 28. One significant advantage with this design is that the medium that flows within the cell 10 (here, the heat absorbing medium 10) exercises pressure on the plates in such a way that the first ridges 33 and the fourth ridges 39 are pressed against each other, which means that the points of intersection work as spacing elements between the cells. These spacing elements (second points of intersection) are of importance for the stability of the construction since the heat absorbing medium 10 has a considerably higher pressure than the heat-emitting medium, where the spacing elements thus prevent the plates 2 from deforming between the first flow channels 7 and the second flow channels 8. From traditional designs, it is known to place special spacing elements between the plates, especially in the cross-stream sections in order to achieve the above-mentioned effect, which is both expensive and time consuming.

When the cells have been stacked, the outer spacing elements 17 are welded together, either after parts of the stacking procedure have been carried out or when all of the cells 15 included in the recuperator have been stacked, which gives a gas tight unit between the welded outer spacing elements 17. In order to further guarantee completely gas tight sides, the sides formed by the edge parts 3–6 of the plates 2, may be coated with material via further welding. Between the plates 2 and the outer spacing elements 17, second inlet openings 53 are formed along the fourth edge part 6 and second outlet openings 54 are formed along the third edge part 5, for the heat-emitting medium 9.

The heat absorbing medium 10 that flows through the cell expands while absorbing heat from the heat-emitting medium 9, and thus the first outlet opening 12, according to the invention, is made wider than the first inlet opening 11, which also results in that the first cross-stream section 46 having a different shape than the second cross-stream section 47. The heat absorbing medium 10 flows essentially diametrically through the recuperator; that is, in at one short side and out on the other short side. The heat-emitting medium 9 comes preferably from a gas turbine device, which medium exits the gas turbine device at essentially atmospheric pressure, while the heat absorbing medium is compressed to 4–9 bar, advantageously 4.5 bar. The recuperator may of course be used at other pressures, both regarding the heat-emitting medium and the heat-absorbing medium.

One of the big advantages with the present invention lies in that the in-going and out-going junction channels 13, 14, respectively, may be formed independently of how the plates are formed. In the above-mentioned embodiments, it has been stated that the medium that flows through the cells flows diametrically through the recuperator. This is done in order to distribute the pressure losses in the recuperator in the best way; that is, if the medium that flows through the cell should go in and out on the same side, the air would take the way that presents the least pressure resistance, which is the closest way. The main part of the air would thus flow through the first cells if the cells were of the same size. In order to remedy this when using prior art devices, one should have to manufacture cells with different thicknesses; that is, different sizes of the flow channels. According to the present invention, the in-going and out-going junction channels 13, 14 can be formed in such a way that these skew pressure losses may be eliminated. The in-going and out-going junction channels may be made cone-shaped with an essentially circular cross-section in one end and an essentially elliptical cross-section at the other end, with a constant width of the respective longitudinal openings of the junction channels. Regardless of the shape of the in-going and out-going junction channels 13, 14, they are easily applied to the stacked cells by welding. The advantages of the invention are also achieved by allowing the first in-going and out-going openings 11, 12 to be made of different sizes by adjusting the inner spacing element 16; for example, in order to compensate for modified mass flows or the like.

Figure 10:
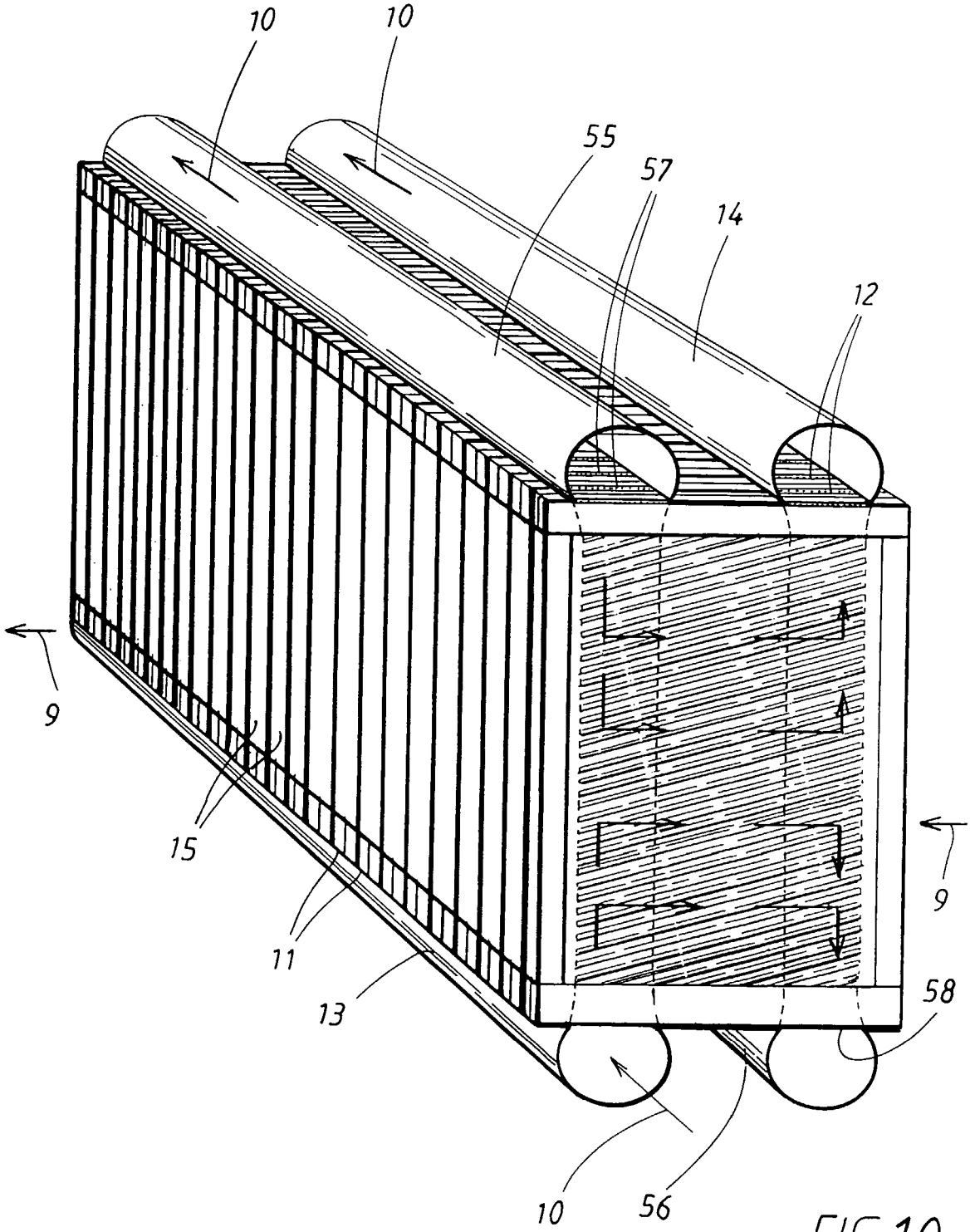
FIG. 10 is a schematic view showing a recuperator configured according to a second embodiment of the invention.

In order to further strengthen the structure, additional in-going and out-going junction channels 55, 56 may be welded to the recuperator. This embodiment of the invention is especially shown in FIG. 10. The additional junction channels 55, 56 are welded parallel to each of the previously described in-going and out-going junction channels 13, 4, on the opposite side of the recuperator sides formed by the cells, and to which sides the previously mentioned in-going and out-going junction channels 13, 14 are welded, in the same manner as has been described regarding the welding of the previously described in-going and out-going junction channels to the recuperator sides. The additional in-going and out-going junction channels 55, 56 may here come to substitute any possible above described bolting used to strengthen the construction with the two in-going and out-going junction channels 13, 14. However, bolting may be used to strengthen the construction even for this embodiment.

Additional inlet and outlet openings 57, 58 are advantageously formed by removing parts of the inner spacing element 16 along that distance that constitutes the width of the longitudinal openings of the additional in-going and out-going junction channels 55, 56; i.e., in the same way as the forming of the first inlet and outlet openings 11, 12. As previously described, additional pleated end sections of the inner spacing element may be placed in the additional inlet and outlet openings 57, 58 where the pleated end sections constitute spacing elements.

With this embodiment, certain advantages are achieved because the load on the recuperator is distributed over all the in-going and out-going junction channels, which gives a symmetrical load. Still further, the cross-stream sections and counter-stream sections are mainly rectangular as opposed to previously shown embodiments.

The additional in-going and out-going junction channels 55, 56 are welded, as are the in-going and out-going junction channels 13, 14, to the respective end cover plates which are not shown.

When manufacturing a recuperator, it is important that the medium streams be optimal through the various parts of the recuperator. For example, the height of the inlet openings is of importance. The thickness of said outer spacing element 17 is therefore advantageously twice the thickness of the inner spacing element 16.

When manufacturing a recuperator according to the invention, a number of advantages are achieved. The plates are made mainly rectangular with a simple corrugated pattern. This means that one can easily produce such plates by embossing, punching and cutting in the same process step. Previously known recuperator plates have had complicated channel holes punched from the plate, where the channel holes together with channel holes from other plates shall fit together, which has meant unnecessarily high demands on tolerances and matching, and furthermore has made it difficult to manufacture a plate in one process step. Cutting, punching and milling has previously been carried out in several steps.

One additional advantage with a non-complicated rectangular plate is that folding and overlapping the edge parts may form the spacing elements, or parts of the spacing elements.

In order to further describe the invention, an example of construction and operating conditions for a recuperator according to the invention will be given below. The example shall not be seen as limiting for the invention; all parameters may be altered, for example by other operating conditions. Every parameter will be given a discrete value, but this shall only be used in the example and may not be seen as limiting for the invention.

The example shows a recuperator with a mass flow at 0.002 kg/s per cell, with a total of 390 cells. The plates are made of stainless steel and preferably with a thickness of 0.12, mm and are corrugated with patterns according to the above. The inner spacing elements have a thickness of 0.9 mm and the outer spacing elements have a thickness of 0.45 mm. The first inlet opening has advantageously a width of 60 mm and the first outlet opening has advantageously a width of 90 mm. Further recuperator data includes: the core package, consisting of stacked cells, 866×420×295 mm; total size 990×420×345; weight 189 kg; temperature efficiency 89%; and total relative pressure loss 4.5%.

In the cell, air flows with the following data: inlet temp 210° C.; outlet temp 610° C.; inlet pressure 4.5 bar; and mass flow 0.78 kg/s.

Between the cells flows combustion gas from a gas turbine with the following data: inlet temp 650° C.; outlet temp 250° C.; inlet pressure 1.1 bar; and mass flow 0.79 kg/s.

The invention is not limited to the above embodiments, but may be varied in different ways within the scope of the appended claims. For example, the indicated mediums do not have to be combustion gases and air respectively, but may be other mediums suitable for the purpose.

The invention claimed is:

1. Plate heat exchanger (1) device advantageously intended for use with a gas turbine, said plate heat exchanger (1) device comprising:

a number of corrugated plates (2), each one with a first edge part (3) with an opposing second edge part (4), a third edge part (5) with an opposing fourth edge part (6), in which first and second flow channels (7, 8) are arranged between the corrugated plates (2), every first flow channel being arranged to have a through flow of a heat-emitting medium (9) and every second being arranged to have a through flow of a heat absorbing medium (10), the first flow channels for one of the mediums, advantageously the heat absorbing medium (10) are, via first inlet openings (11) and first outlet openings (12), respectively, connected essentially parallel to in-going and out-going junction channels (13, 14) for said heat absorbing medium (10), wherein that the plates (2) are fitted to each other in pairs, forming cells (15) comprising an inner spacing element (16) welded to and in-going between the plates, where the inner spacing element (16) extends along the edge parts (3–6) with interruption for the first inlet opening (11) and the first outlet opening (13) for one of the mediums, advantageously the heat-absorbing medium (10), where outer spacing elements (17) are welded to the plates (2) on the sides of the plates (2) facing away from each other, along at least two of the edge parts (3–6), the cells (15) are stacked against each other and joined together by welding via the outer spacing elements (17), and said in-going and out-going junction channels (13, 14) are welded to said first inlet opening (11) and first outlet opening (12), respectively;

said first outlet opening (12) is wider than the first inlet opening (11);

said inner spacing element (16) of the cell (15) consists of a first inner spacing element (18) along the first edge part (3) and the fourth edge part (6) and a second inner spacing element (19) along the second edge part (4) and the third edge part (5), the first inner spacing element (18) has a first end section (20) thinner than the rest of the first spacing element (18), where the first end section (20) is pleated along the extension of the first inlet opening (11), and the second inner spacing element (19) has a second end section (21) thinner than the rest of the second spacing element (19), where the second end section (21) is pleated along the extension of the first outlet opening (12);

each of the pleated end sections (20, 21) of the first and second inner spacing elements (18, 19), has a first and a second pleating height, respectively (22, 23), which allows the pleated end sections (20, 21) to act as spacing elements in the first inlet opening (11) and the first outlet opening (12), respectively;

said corrugated plates (2) are divided into first plates (24) with a first side (25) and a second side (26), corrugated with a first pattern (27), and second plates (28) with a third side (29) and a fourth side (30) corrugated with a second pattern (31), which first and second plates (24, 28) are assembled in pairs with the second side (26) towards the third side (29); and said first plates (24) are corrugated in such a way that each of the first plates has first depressions (32) and first ridges (33) on the first side, and correspondingly second depressions (34) and second ridges (35) on the second side (26), diagonally from the third edge part (5) to the fourth edge part (6), with the first and the fourth edge parts (3, 6) constituting catheti in an imaginary triangle with the diagonal first depressions (32) as hypotenuse, and in that each of the second plates (28) has third depressions (36) and third ridges (37) on the third side (29), and correspondingly fourth depressions (38) and fourth ridges (39) on the fourth side (30), diagonally from the fourth edge part (6) to the third edge part (5), with the first and third edge parts (3, 5) constituting catheti in an imaginary triangle with the diagonal third depressions (36) as hypotenuse.

2. Plate heat exchanger (1) device according to claim 1, wherein the depth of the first and fourth depressions (32, 38), respectively, varies in such a way that a first inlet triangle (40) and a first outlet triangle (41) with a first depth (49) on the first depressions (32) are formed in the first plate (24), and a second inlet triangle (42) and a second outlet triangle (43) with a second depth of the fourth depressions (38) are formed in the second plate (28), which first and second inlet triangles (40, 42) have a feature in the shape of a triangle at the respective plates (24, 28), with an imaginary cathetus along the first edge part (3) with a length corresponding to the first inlet opening (11), an imaginary cathetus in the third end part (5) and an imaginary hypotenuse from the first edge part (3) to the second edge part (4), where each of the first and second outlet triangles (41, 43) has the shape of an imaginary cathetus along the second edge part (4) with a length corresponding to the first outlet opening (12), an imaginary cathetus in the fourth edge part (6) and an imaginary hypotenuse from the second edge part (4) to the to the first edge part (3), and the first plate also has a first diagonal section (44) with a third depth (50) of the first depressions (32), the second plate (28) has a second diagonal section (45) with a fourth depth of the fourth depressions (38, which diagonal sections (44, 45) are formed diagonally over each of the plates (24, 28) between the inlet triangles and outlet triangles respectively.

3. Plate heat exchanger (1) device according to claim 2, wherein each of the first and second plates, the first inlet triangle (40) and the second inlet triangle (42) have the same geometrical shape, and the first diagonal section (44) and the second diagonal section (45) have the same geometrical shape, and the first outlet triangle (41) and the second outlet triangle (43) have the same geometrical shape.

4. Plate heat exchanger (1) device according to claim 3, wherein the cells (15) consist of the first and second plates (24, 28) joined in pairs with the second and third sides (26, 29) placed towards each other, wherein the second ridges (35) form an angle with the third ridges (37), and in that the first and second inlet triangles (40, 42) form a first cross-stream section (46), the first and second outlet triangles (41, 43) form a second cross-stream section (47), and in that the first and second diagonal sections (44, 45) form a counter-stream section (48).

5. Plate heat exchanger (1) device according to claim 4, wherein the second ridges (35) are in contact with the third ridges (37) in the first points of intersection at that part of the cell (15) that is formed by the diagonal sections (44, 45) of the plates (24, 28).

6. Plate heat exchanger (1) device according to claim 5, wherein the cells (15) are stacked against each other with the first and fourth sides (25, 30) of the plates (24, 28) towards each other.

7. Plate heat exchanger (1) device according to claim 6, wherein the first ridges (33) form an angle to the fourth ridges (39) when the cells (15) are stacked, and additionally the first ridges (33) are in contact with the fourth ridges (39) in the second points of intersection.

8. Plate heat exchanger (1) device according to claim 7, wherein the thickness of said outer spacing element (17) is such that the upper edge of the outer spacing elements (17) is in alignment with the first ridges (33) on the first side (25) and is in alignment with the fourth ridges (39) on the fourth side (30).

9. Plate heat exchanger (1) device according to claim 8, wherein the thickness of said outer spacing element (17) is essentially twice the thickness of the inner spacing element.

10. Plate heat exchanger (1) device according to claim 9, wherein additional in-going and out-going junction channels (55, 56) are welded to the recuperator, parallel to the in-going and out-going junction channels (13, 14), on the opposite side of the recuperator sides formed by the cells (15), where the in-going and out-going junction channels (13, 14) are welded to the sides.

11. Plate heat exchanger (1) device according to claim 10, wherein the additional inlet and outlet openings (57, 58) are arranged in the cell (15) on that distance that is formed by the width of the respective longitudinal openings of the in-going and out-going junction channels (55, 56).

* * * * *